US009940758B2

(12) United States Patent
Krueger et al.

(10) Patent No.: US 9,940,758 B2
(45) Date of Patent: Apr. 10, 2018

(54) METHOD FOR COMMUNICATING VEHICLE DATA OF A VEHICLE

(71) Applicant: Bayerische Motoren Werke Aktiengesellschaft, Munich (DE)

(72) Inventors: Uwe Krueger, Haar (DE); Werner Herrmann, Munich (DE); Julius Teske, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/602,347

(22) Filed: Jan. 22, 2015

(65) Prior Publication Data

US 2015/0134193 A1 May 14, 2015

Related U.S. Application Data

(63) Continuation of application No. PCT/EP2013/065418, filed on Jul. 22, 2013.

(30) Foreign Application Priority Data

Jul. 24, 2012 (DE) ..... 10 2012 212 958

(51) Int. Cl.
*G07C 5/00* (2006.01)

(52) U.S. Cl.
CPC ..... *G07C 5/008* (2013.01)

(58) Field of Classification Search
CPC ..... G07C 5/008; G07C 5/085; G06Q 10/00; G06Q 10/107; G06Q 30/02; G06Q 50/30; Y10S 370/908; G01C 21/362; G01C 21/3407
USPC ..... 701/29.1, 431, 31.5, 31.4, 32.1, 32.4, 701/32.7, 29.4, 29.6, 31.6; 340/425.5, 340/438, 442
See application file for complete search history.

(56) References Cited

U.S. PATENT DOCUMENTS

| | | | | |
|---|---|---|---|---|
| 7,412,962 | B1 | 8/2008 | Nelson et al. | |
| 2005/0228559 | A1 | 10/2005 | Bloch et al. | |
| 2008/0059476 | A1 | 3/2008 | Alrabady | |
| 2009/0177352 | A1* | 7/2009 | Grau | G07C 5/008 701/31.4 |
| 2010/0324777 | A1* | 12/2010 | Tominaga | G07C 5/0808 701/31.4 |
| 2012/0123629 | A1* | 5/2012 | Edwards | G01C 21/362 701/29.1 |

(Continued)

FOREIGN PATENT DOCUMENTS

| | | | |
|---|---|---|---|
| DE | 10 2006 009 098 | A1 | 8/2007 |
| DE | 10 2007 041 881 | A1 | 5/2008 |

OTHER PUBLICATIONS

International Search Report (PCT/ISA/210) dated Oct. 17, 2013, with English translation (four (4) pages).

*Primary Examiner* — Nga X Nguyen
(74) *Attorney, Agent, or Firm* — Crowell & Moring LLP

(57) ABSTRACT

A method for communicating vehicle data relating to a vehicle automatically determines whether a vehicle is in a predefined surrounding area of a service facility. If this has been detected, a predefined set of vehicle data is provided via a communication interface of the vehicle for transmission to a vehicle data collection device. The set of vehicle data received by the vehicle data collection device is at least partially made available to the service facility.

16 Claims, 3 Drawing Sheets

(56) References Cited

U.S. PATENT DOCUMENTS

| | | | | |
|---|---|---|---|---|
| 2012/0303203 | A1* | 11/2012 | Olsen | G08G 1/0133<br>701/29.1 |
| 2013/0193918 | A1* | 8/2013 | Sarkar | B60L 3/04<br>320/109 |

* cited by examiner

METHOD FOR COMMUNICATING VEHICLE DATA OF A VEHICLE

CROSS REFERENCE TO RELATED APPLICATIONS

This application is a continuation of PCT International Application No. PCT/EP2013/065418, filed Jul. 22, 2013, which claims priority under 35 U.S.C. § 119 from German Patent Application No. 10 2012 212 958.8, filed Jul. 24, 2012, the entire disclosures of which are herein expressly incorporated by reference.

BACKGROUND AND SUMMARY OF THE INVENTION

The invention relates to a method for communicating vehicle data relating to a vehicle.

Vehicle data relating to a vehicle are read, for example, during a service shop visit, using a tester which is directly connected to the vehicle. In this case, contact is made manually using a diagnostic connector and vehicle data are then automatically transmitted.

U.S. Pat. No. 7,142,962 B1 discloses a method for preparing for servicing of a motor vehicle, in which a control apparatus checks whether vehicle servicing needs to be carried out and a state determination apparatus determines what vehicle servicing needs to be carried out and what corresponding servicing data have been stored in the vehicle. Only the driver of the vehicle can enable the setting-up of a telecommunications link between a service facility outside the vehicle and a service interface inside the vehicle. Identification data relating to the relevant vehicle are transmitted to the service facility outside the vehicle during the telecommunications link.

The object on which the invention is based is to provide a method for communicating vehicle data relating to a vehicle, which method is efficient.

This and other objects are achieved by a method according to the invention for communicating vehicle data relating to a vehicle, in which it is automatically determined whether the vehicle is in a predefined surrounding area of a service facility. If it has been detected that the vehicle is in the predefined surrounding area of the service facility, a predefined set of vehicle data is provided via a communication interface of the vehicle for transmission to a vehicle data collection device. The set of vehicle data relating to the vehicle received by the vehicle data collection device is at least partially made available to the service facility.

The advantage of this method is that vehicle data do not have to be first read with manual support, for example during a service. The service facility already has current vehicle data shortly after the vehicle arrives. Time and therefore also costs can thus be saved.

According to one advantageous refinement, a vehicle's own position signal which is characteristic of the position of the vehicle is provided. A service position signal which is characteristic of the position of the service facility is also provided. It is determined, on the basis of the vehicle's own position signal and the service position signal, whether the vehicle is in the predefined surrounding area of the service facility. The advantage of this refinement is that the hardware required for this is often already present and therefore no additional costs for detecting the vehicle position are required.

According to another advantageous refinement, a service radio network is provided via a service radio device of the service facility. The vehicle has a vehicle radio device. The vehicle radio device registers in the service radio network if the vehicle is in the range of the latter. It is determined, on the basis of the registration, whether the vehicle is in the predefined surrounding area of the service facility. The service radio network may be, for example, a mobile radio network, a WLAN network, a PLC network or a radio network for transmission using bidirectional keys. The advantage in this case is that there is no need for a satellite-based measurement principle in order to determine whether the vehicle is in the predefined surrounding area of the service facility.

According to another advantageous refinement, a vehicle radio network is provided via the vehicle radio device. The service radio device registers in the vehicle radio network if it is in the range of the latter. It is determined, on the basis of the registration, whether the vehicle is in the predefined surrounding area of the service facility. The vehicle radio network can be implemented using the same technologies as the service radio network.

According to another advantageous refinement, vehicle data relating to the vehicle are transmitted to the vehicle data collection device if a predefined event is detected. It is determined, on the basis of the transmitted vehicle data, whether the vehicle is in the predefined surrounding area of the service facility.

According to another advantageous refinement, the predefined event is the parking of the vehicle.

According to another advantageous refinement, the service radio network or the vehicle radio network is verified by a digital certificate. Therefore, it is possible to determine, with increased certainty, whether the service radio network is a radio network of the service facility and whether the vehicle radio network is a radio network of the vehicle.

According to another advantageous refinement, further vehicle data can be requested by the vehicle data collection device, for example after evaluation of the received set of vehicle data. If, for example, the vehicle data have information characteristic of a specific fault, further data, for example historical data and/or characteristic data, can be requested from special sensors.

According to another advantageous refinement, the service facility has an RFID reader and the vehicle has an RFID transponder. It is determined, on the basis of the detection of the RFID transponder using the RFID reader, whether the vehicle is in the predefined surrounding area of the service facility. For example, an RFID reader may be fitted at the entrance to the service facility, which reader detects the respective RFID transponder which is assigned to an entering vehicle.

According to another advantageous refinement, the service radio network or the vehicle radio network is a WLAN network.

According to another advantageous refinement, the service radio network or the vehicle radio network is a mobile radio network.

According to another advantageous refinement, the vehicle data collection device transmits the service position signal to the vehicle. It is determined, on the basis of said signal, whether the vehicle is in the predefined surrounding area of the service facility. For example, the vehicle data collection device transmits a navigation destination to the vehicle after the driver has made a workshop appointment, for example as part of a "service call". This destination is stored in the vehicle and, as soon as the vehicle approaches this destination, it is detected that the vehicle is in the predefined surrounding area of the service facility.

According to another advantageous refinement, it is determined, on the basis of induction loops, whether the vehicle is in the predefined surrounding area of the service facility. Induction loops which detect entering vehicles can be installed, for example, at the entrance to the service facility for this purpose.

According to another advantageous refinement, it is determined, on the basis of at least one mobile radio cell, in the range of which the vehicle is situated, whether the vehicle is in the predefined surrounding area of the service facility. If the vehicle is in the range of a plurality of mobile radio cells for example, it can be more accurately determined, on the basis thereof, whether the vehicle is in the predefined surrounding area of the service facility.

In addition, the transmission of the vehicle data can also be optionally initiated manually. For example, the driver can initiate automatic data transmission via the communication interface upon reaching a parked position via the vehicle menu or in a voice-controlled manner. A service adviser in the service facility can also initiate automatic data transmission via the communication interface by starting, for example, a query of vehicle data which is initiated using the vehicle data collection device.

It is also possible to carry out remote vehicle diagnosis. For example, vehicle data can be transmitted on the basis of the event. After said data have been evaluated, the vehicle data collection device may request further data for vehicle diagnosis, for example. It is possible that, in some cases, the vehicle no longer has to be brought to the workshop if electrical components need to be diagnosed and assessed, for example.

Other objects, advantages and novel features of the present invention will become apparent from the following detailed description of one or more preferred embodiments when considered in conjunction with the accompanying drawings.

DETAILED DESCRIPTION OF THE DRAWINGS

Elements having the same design or function are identified by the same reference symbols throughout the figures.

Figure 1:
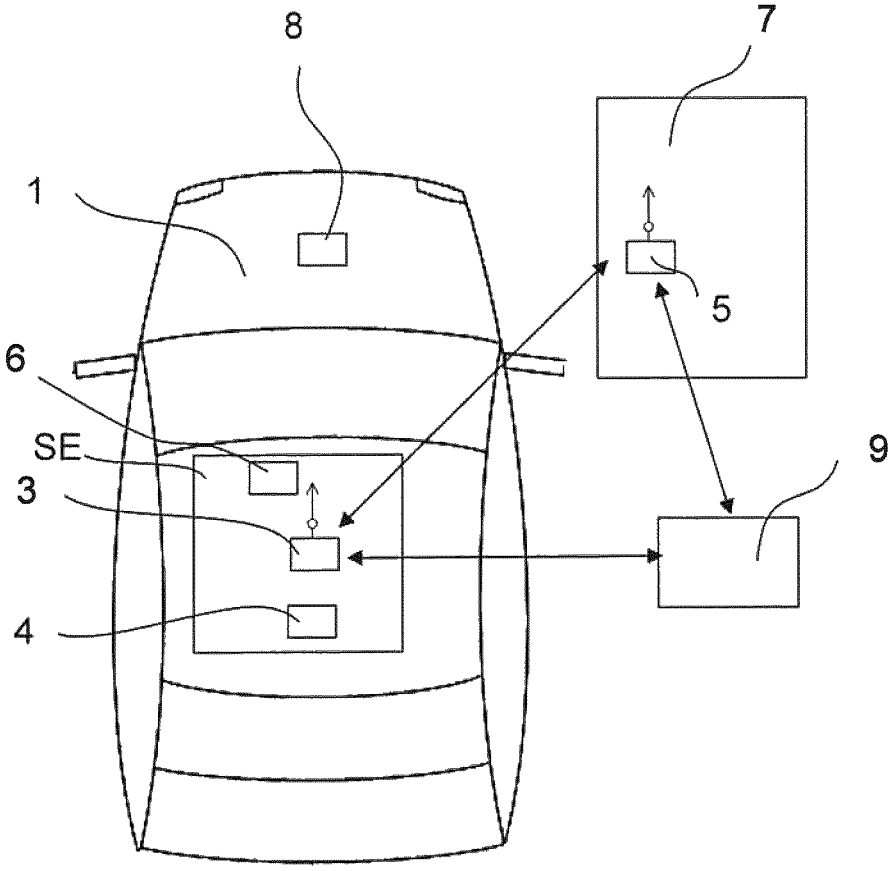
FIG. 1 is a schematic diagram illustrating a vehicle in association with a service facility and data collection device for carrying out an exemplary method according to the invention.

Referring to FIG. 1, a control unit SE having a computing unit, a data and program memory and a communication interface is arranged in a vehicle 1. The control unit SE may be in the form of a structural unit. However, it may also be distributed among two or more structural units arranged in the vehicle 1.

The communication interface is designed, for example, to provide vehicle data for transmission to a vehicle data collection device 9 or a service facility 7. Transmission can be implemented using different transmission technologies, for example WLAN, RFID, PLC, mobile radio, transmission using bidirectional keys or another transmission technology which is known to the relevant person skilled in the art for these purposes.

The control unit SE has a vehicle radio device 3, a position determination device 4 and/or a navigation device 6, for example. The vehicle radio device 3, the position determination device 4 and/or the navigation device 6 may be arranged in a structural unit. However, they may also be distributed in any desired manner among two or more structural units.

The vehicle radio device 3 is designed, for example, to provide a vehicle radio network F_NET and/or to register in a service radio network S_NET. The vehicle radio network F_NET or the service radio network S_NET can be implemented using the same transmission technologies as the vehicle data transmission already mentioned.

The position determination device 4 has a measuring apparatus based on a satellite-based measurement principle, for example Galileo or GPS. The position determination device 4 is designed, for example, to provide a vehicle's own position signal E_POS which is characteristic of the position of the vehicle 1.

The navigation device 6 is designed, for example, to provide a service position signal S_POS which is characteristic of the position of the service facility 7. The service position signal S_POS is stored, for example, in a data memory of the navigation device 6. For example, the service position signal S_POS can be stored as a navigation destination in the data memory of the navigation device 6.

As an alternative or in addition to the vehicle radio device 3, the position determination device 4 and/or the navigation device 6, the vehicle 1 has an RFID transponder 8.

The vehicle data collection device 9 is outside the vehicle 1. The vehicle data collection device 9 can also be in the form of a "backend". It may be in the form of a unit or may be distributed among a plurality of units. It may be formed in the service facility 7 and/or outside the latter. It is designed, for example, to centrally store and provide vehicle data.

The service facility 7 is arranged outside the vehicle 1. The service facility 7 may be, for example, a dealer or service partner or else a vehicle distributor, a vehicle manufacturer or a car rental service, for example. It may have a service radio device 5, for example.

The service radio device 5 is designed, for example, to provide the service radio network S_NET and/or to register in the vehicle radio network F_NET.

Alternatively or additionally, the service facility 7 has an RFID reader which is designed to detect the RFID transponder 8. The RFID reader is positioned, for example, at the entrance to the service facility 7.

Alternatively or additionally, the service facility 7 has one or more induction loops. The induction loop(s) is/are fitted at the entrance to the service facility 7, for example. The induction loop(s) is/are designed, for example, to detect the vehicle 1.

Figure 2:
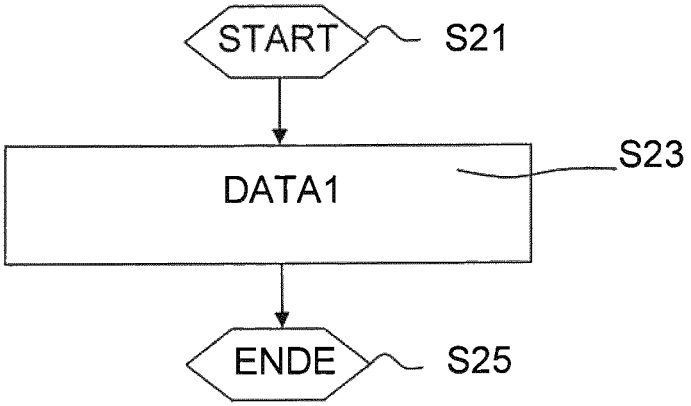
FIG. 2 is a flowchart illustrating the communication of vehicle data.

A first program which is possibly executed in a manner distributed among the control unit SE, the vehicle data collection device 9 and the service facility 7 or a subset thereof (likewise FIG. 2) is explained in more detail below using the flowchart in FIG. 2.

The program is started in a step S21 in which variables can be initialized, if necessary.

In a step S23, a first set DATA1 of vehicle data is provided for transmission to the vehicle data collection device 9. The vehicle data may contain, for example, data for identifying the vehicle 1, for example key data and/or the chassis number, and may also contain the vehicle's own position signal E_POS, data from a fault memory of the vehicle, diagnostic data, for example temperature profiles of the vehicle hard disk and/or characteristic data from a control device of the vehicle 1. The vehicle data may additionally or alternatively contain an item of information relating to the brake disks, brake pads and/or the engine state.

The first set DATA1 of vehicle data is transmitted after a predefined vehicle event has been detected. The vehicle event may be, for example, the parking, leaving or locking of the vehicle 1. The vehicle event may also be the reaching of a predefined mileage of the vehicle 1, for example occurrence of the vehicle event every 1000 km. The vehicle event may also be the expiration of a predefined time, for example occurrence of the vehicle event every 30 days. This transmission of vehicle data enables evaluation and analysis processes which fulfill a preventative purpose. It is therefore possible to detect fault patterns which may result in critical situations in the future, for example potential battery problems. In addition, important information can be forwarded to the driver on the basis of the evaluation of the first set DATA1 of vehicle data.

In a step S25, the program is ended and can be restarted in step S21, if necessary.

Technical defects are indicated in the vehicle using so-called fault entries and check control messages. With the flowchart described in FIG. 3, it is also possible for the service facility to already have vehicle data as a result of a "service call". This "service call" may have been automatically triggered by the vehicle, for example, on the basis of the fault entries or vehicle states. After transmitting the "service call", the service facility can contact the driver, for example, in order to propose an appointment at the service facility. The "service call" can also have been manually triggered by the service facility or the driver. The "service call" may be made, for example, using a mobile radio device permanently installed in the vehicle. Although said vehicle data make it possible for the service adviser to competently advise the driver and agree upon a suitable appointment at the service facility, it may happen that new relevant vehicle data are also added before the actual visit to the service facility because a new fault has occurred in the vehicle, for example. The flowchart described in FIG. 3, which is described below, makes it possible for current data to be available when visiting the service facility.

Figure 3:
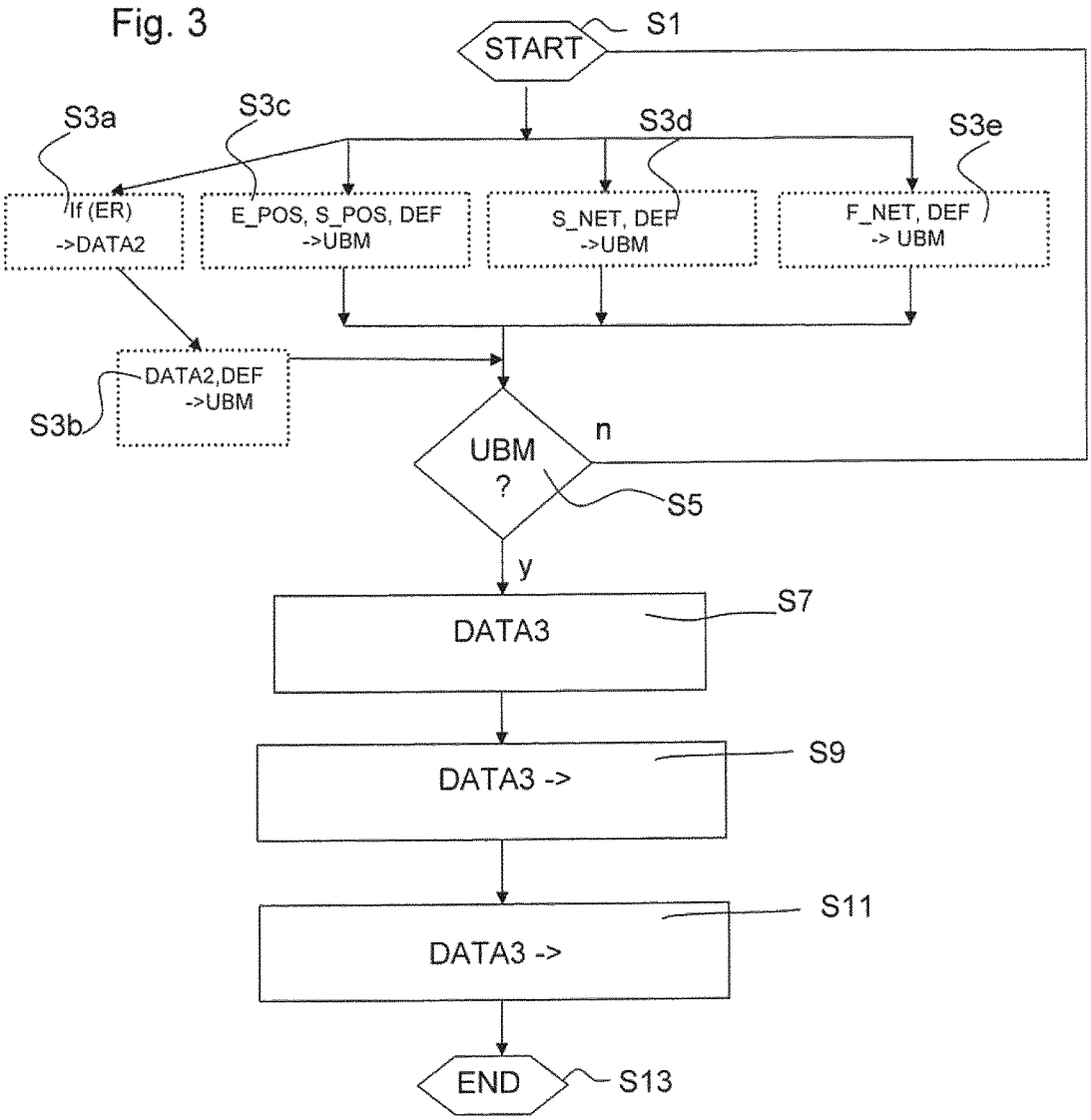
FIG. 3 is another flowchart illustrating the communication of vehicle data.

A second program which is possibly executed in a manner distributed among the control unit SE, the vehicle data collection device 9 and the service facility 7 or a subset thereof is explained in more detail below using the flowchart in FIG. 3.

The program is started in a step S1 in which variables can be initialized, if necessary.

In a step S3*a*, a check is carried out in order to determine whether a predefined event ER has occurred. If the predefined event ER is detected, a second set DATA2 of vehicle data is provided by the control unit SE for transmission to the vehicle data collection device 9. The predefined event ER is, for example, the parking, leaving or locking of the vehicle 1. The predefined event ER may additionally or alternatively also be triggered by fault information from a sensor installed in the vehicle 1. The second set DATA2 of vehicle data provided for transmission contains, in particular, the vehicle's own position signal E_POS for the vehicle 1 and/or vehicle identification data, for example the chassis number.

The second set DATA2 of vehicle data provided is transmitted to the vehicle data collection device 9 in a step S3*b*. For example, it is determined, on the basis of the information contained in the vehicle's own position signal E_POS, whether the vehicle 1 is in the predefined surrounding area DEF of the service facility 7. In addition, it is determined, for example on the basis of the vehicle identification data, whether the vehicle 1 has a service appointment. If it is determined that the vehicle 1 is in the predefined surrounding area DEF of the service facility 7, a surrounding area marker UBM is set. If it is determined that the vehicle 1 is not in the predefined surrounding area DEF of the service facility 7, the surrounding area marker UBM is not set.

In a step S3*c*, the vehicle's own position signal E_POS and the service position signal S_POS are provided. The vehicle's own position signal E_POS for the vehicle 1 is provided by the position determination device 4, for example. The service position signal S_POS is provided by the navigation device 6 and/or by the vehicle data collection device 9 and/or by the service facility 7, for example. It is determined, on the basis of the service position signal S_POS and the vehicle's own position signal E_POS, whether the vehicle 1 is in the predefined surrounding area DEF of the service facility 7. If it is determined that the vehicle 1 is in the predefined surrounding area DEF of the service facility 7, the surrounding area marker UBM is set. If it is determined that the vehicle 1 is not in the predefined surrounding area DEF of the service facility 7, the surrounding area marker UBM is not set.

In a step S3*d*, the service radio network S_NET is provided by the service radio device 5. As soon as the vehicle radio device 3 detects the service radio network S_NET, for example when it is in the range of the latter, it registers in the service radio network S_NET. The service radio network S_NET can be verified using a digital certificate. It is determined, on the basis of the registration, whether the vehicle 1 is in the predefined surrounding area DEF of the service facility 7. If it is determined that the vehicle 1 is in the predefined surrounding area DEF of the service facility 7, the surrounding area marker UBM is set. If it is determined that the vehicle 1 is not in the predefined surrounding area DEF of the service facility 7, the surrounding area marker UBM is not set.

In a step S3*e*, the vehicle radio network F_NET is provided by the vehicle radio device 3. The service radio device 5 registers in the vehicle radio network F_NET as soon as it is in the range of the latter. It is determined, on the basis of the registration, whether the vehicle 1 is in the predefined surrounding area DEF of the service facility 7. If it is determined that the vehicle 1 is in the predefined surrounding area DEF of the service facility 7, the surrounding area marker UBM is set. If it is determined that the vehicle 1 is not in the predefined surrounding area DEF of the service facility 7, the surrounding area marker UBM is not set.

Steps S3*a*-S3*e* can each be carried out alternatively or in a different combination with one another.

The surrounding area marker UBM can also alternatively or additionally be set on the basis of the detection of the RFID transponder 8 fitted in the vehicle 1 using the RFID reader of the service facility 7. The surrounding area marker UBM can also alternatively or additionally be set on the basis of the detection of the vehicle 1 using induction loops of the service facility 7. It is also additionally or alternatively possible for the surrounding area marker UBM to be set on the basis of localization using mobile radio cells, in which it is determined whether the vehicle 1 is in the predefined surrounding area DEF of the service facility 7.

In step S5, a check is carried out in order to determine whether or not the surrounding area marker UBM is set. If the surrounding area marker UBM is set, processing is continued in step S7. If it is determined that the surrounding area marker is not set, the program is restarted again in step S1, possibly after a predefined waiting time.

In a step S7, a third set DATA3 of vehicle data is provided via the communication interface of the control unit SE. The third set DATA3 of vehicle data is provided for transmission to the vehicle data collection device 9.

In a step S9, the third set DATA3 of vehicle data is transmitted to the vehicle data collection device 9. Transmission can be initiated both by the vehicle data collection device 9 and the communication interface of the control unit SE, to be precise depending on whether it is determined, in the vehicle data collection device 9 or in the control unit SE, whether the vehicle 1 is in the predefined surrounding area DEF of the service facility 7.

In a step S11, the third set DATA3 of vehicle data or at least part of the third set DATA3 of vehicle data relating to the vehicle 1 is transmitted to the service facility 7. After evaluating this part of the third set DATA3 of vehicle data, it is possible for further vehicle data to be requested by the vehicle data collection device 9, which data are then provided by the control unit SE. If, for example, the part of the third set DATA3 of vehicle data has information characteristic of a specific fault, further vehicle data, for example historical data and/or characteristic data, may be requested from special sensors.

The program is then ended in a step S13 and can be restarted in step S1, if necessary.

Without a procedure in which it is detected whether a vehicle is in a surrounding area of a service facility, a service acceptance process is defined, for example, in such a manner that a service adviser in the service facility receives the key of a vehicle from the customer at the counter and key data relating to the vehicle are read using a key reader. Since the reading of the key data does not allow any conclusions to be drawn on fault memory information relating to the vehicle, further reading of vehicle data is additionally required in any case. This can be carried out if the vehicle is physically at the service facility and is connected to a diagnostic system or using bidirectional vehicle access. The flowchart described in FIG. 3 makes it possible for the necessary vehicle data to already be present for an entire service shop process in the service facility when the customer is served at the counter.

In addition, it is possibly no longer necessary for the vehicle to be physically in the service facility for vehicle diagnosis since the vehicle data can be wirelessly transmitted.

LIST OF REFERENCE SYMBOLS

1 Vehicle
3 Vehicle radio device
4 Position determination device
5 Service radio device
6 Navigation device
7 Service facility
8 RFID transponder
9 Vehicle data collection device
ER Event
E_POS Vehicle's own position signal
S_POS Service position signal
S_NET Service radio network
F_NET Vehicle radio network
SE Control unit
DATA1 First set of vehicle data
DATA2 Second set of vehicle data
DATA3 Third set of vehicle data
DEF Predefined surrounding area
UBM Surrounding area marker The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for communicating vehicle data relating to a vehicle, the method comprising the acts of:

receiving, by a vehicle data collection device, a first predefined set of vehicle data transmitted via a communication interface of the vehicle, when it is determined that a predefined event associated with the vehicle has occurred, wherein the first predefined set of vehicle data includes one or more of: (i) a position of the vehicle and (ii) vehicle identification data;

determining, by the vehicle data collection device, automatically whether the vehicle is in a predefined surrounding area of a service facility based at least in part on the received first predefined set of vehicle data;

receiving, by the vehicle data collection device, a second predefined set of vehicle data relating to the vehicle transmitted via the communication interface of the vehicle, only if it is determined that the vehicle is in the predefined surrounding area of the service facility, wherein the predefined surrounding area of the service facility includes at least the service facility;

at least partially making available, by the vehicle data collection device, the received second predefined set of vehicle data relating to the vehicle received by the vehicle data collection device for use at the service facility prior to servicing the vehicle; and evaluating, by the vehicle data collection device, the received second predefined set of vehicle data, and based on the evaluation, requesting, by the vehicle data collection device, further vehicle data from the vehicle, the further vehicle data being specific to certain information provided in the second predefined set of vehicle data.

2. The method according to claim 1, wherein the act of determining automatically whether the vehicle is in the predefined surrounding area of the service facility comprises the acts of:

obtaining the position of the vehicle from the received first predefined set of vehicle data;

obtaining a service position signal characteristic of a position of the service facility; and based on the vehicle's own position signal and the service position signal, determining whether the vehicle is in the predefined surrounding area of the service facility.

3. The method according to claim 2, further comprising the acts of:

providing a service radio network via a service radio device of the service facility; and registering, in the service radio network, a vehicle radio device of the vehicle if the vehicle is in range of the service radio network; and determining, based on the registration, whether the vehicle is in the predefined surrounding area of the service facility.

4. The method according to claim 1, further comprising the acts of:

providing a service radio network via a service radio device of the service facility; and registering, in the service radio network, a vehicle radio device of the vehicle if the vehicle is in range of the service radio network; and determining, based on the registration, whether the vehicle is in the predefined surrounding area of the service facility.

5. The method according to claim 4, further comprising the acts of:

providing a vehicle radio network via the vehicle radio device of the vehicle;

registering, in the vehicle radio network, the service radio device of the service facility if the service radio device is in a range of the vehicle radio network; and determining, based on the registration, whether the vehicle is in the predefined surrounding area of the service facility.

6. The method according to claim 3, further comprising the acts of:

providing a vehicle radio network via the vehicle radio device of the vehicle;

registering, in the vehicle radio network, the service radio device of the service facility if the service radio device is in a range of the vehicle radio network; and determining, based on the registration, whether the vehicle is in the predefined surrounding area of the service facility.

7. The method according to claim 1, wherein the vehicle identification data is used to determine whether the vehicle has a service appointment at the service facility.

8. The method according to claim 1, wherein the predefined event is one or more of: (i) a parking of the vehicle, (ii) leaving of the vehicle, (iii) locking of the vehicle, (iv) triggered by fault information from a sensor of the vehicle.

9. The method according to claim 5, wherein the service radio network or the vehicle radio network is verified by a digital certificate.

10. The method according to claim 1, wherein the service facility has an RFID reader and the vehicle has a RFID transponder, wherein the act of determining automatically whether the vehicle is in the predefined surrounding area of the service facility is carried out based on a detection of the RFID transponder using the RFID reader.

11. The method according to claim 5, wherein the service radio network or the vehicle radio network is a WLAN network.

12. The method according to claim 5, wherein the service radio network or the vehicle radio network is a mobile radio network.

13. The method according to claim 1, wherein the vehicle data collection device transmits a service position signal to the vehicle, and further wherein the act of determining automatically whether the vehicle is in the predefined surrounding area is carried out based on the service position signal.

14. The method according to claim 1, wherein the act of determining automatically whether the vehicle is in the predefined surrounding area is carried out based on inductive loop technology.

15. The method according to claim 1, wherein the act of determining automatically whether the vehicle is in the predefined surrounding area is carried out based on at least one mobile radio cell in a range of which the vehicle is located.

16. A method for communicating vehicle data relating to a vehicle, the method comprising the acts of:

transmitting, by a communication interface of the vehicle to a vehicle data collection device outside of the vehicle, a first predefined set of vehicle data when it is determined that a predefined event associated with the vehicle has occurred, wherein the first predefined set of vehicle data includes one or more of: (i) a position of the vehicle and (ii) vehicle identification data;

determining, by a control unit of the vehicle, automatically whether the vehicle is in a predefined surrounding area of a service facility based at least in part on the received first predefined set of vehicle data;

transmitting, by the communication interface of the vehicle to the vehicle data collection device outside of the vehicle, a second predefined set of vehicle data relating to the vehicle only if it is determined that the vehicle is in the predefined surrounding area of the service facility, wherein the predefined surrounding area of the service facility includes at least the service facility, and wherein the set of vehicle data relating to the vehicle is available for use by the service facility prior to servicing the vehicle; and receiving a request, from the vehicle data collection device, for further vehicle data specific to certain information provided in the second predefined set of vehicle data based on an evaluation, by the vehicle data collection device, of the second predefined set of vehicle data.

* * * * *